United States Patent [19]

Podosek

[11] 4,256,411

[45] Mar. 17, 1981

[54] FILE FOLDER WITH INTEGRAL LOOSE LEAF BINDER RINGS

[75] Inventor: Edward Podosek, Wilbraham, Mass.

[73] Assignee: National Blank Book Company, Inc., Holyoke, Mass.

[21] Appl. No.: 39,584

[22] Filed: May 16, 1979

Related U.S. Application Data

[63] Continuation-in-part of Ser. No. 969,801, Dec. 15, 1978, abandoned.

[51] Int. Cl.[3] ..... B42F 3/00

[52] U.S. Cl. ..... 402/73; 402/13; 402/19

[58] Field of Search ..... 281/35, 29; 283/64; 402/7, 8, 13, 15, 19, 21, 75, 76, 80 P, 73, 74, 77

[56] References Cited

U.S. PATENT DOCUMENTS

| | | | |
|---|---|---|---|
| 2,559,556 | 7/1951 | Ambler | 402/15 |
| 3,246,653 | 4/1966 | Sexton | 402/15 |
| 3,362,411 | 1/1968 | Moller | 402/15 |
| 3,362,412 | 1/1968 | Moller | 402/15 |
| 3,834,824 | 9/1974 | Jahn | 402/13 |
| 4,135,832 | 1/1979 | Saltz | 402/15 |
| 4,174,909 | 11/1979 | Jahn | 402/13 |

FOREIGN PATENT DOCUMENTS

| | | | |
|---|---|---|---|
| 725947 | 1/1966 | Canada | 402/19 |

*Primary Examiner*—Paul A. Bell

*Attorney, Agent, or Firm*—Chapin, Neal & Dempsey

[57] ABSTRACT

Loose leaf folder having back and front cover panels and ring binder forming strips integral therewith for releasably fastening loose leaf sheets within the folder. The binder forming strips are struck from the back cover panel and include barbed tips. Retaining cutouts are provided in the front cover opposite the binder strips to register therewith. The barbed end of each strip is engageable with the cutouts to hold said strips in ring-like configuration for fastening hole punched loose leaf sheets within the folder.

2 Claims, 8 Drawing Figures

Fig. 1.
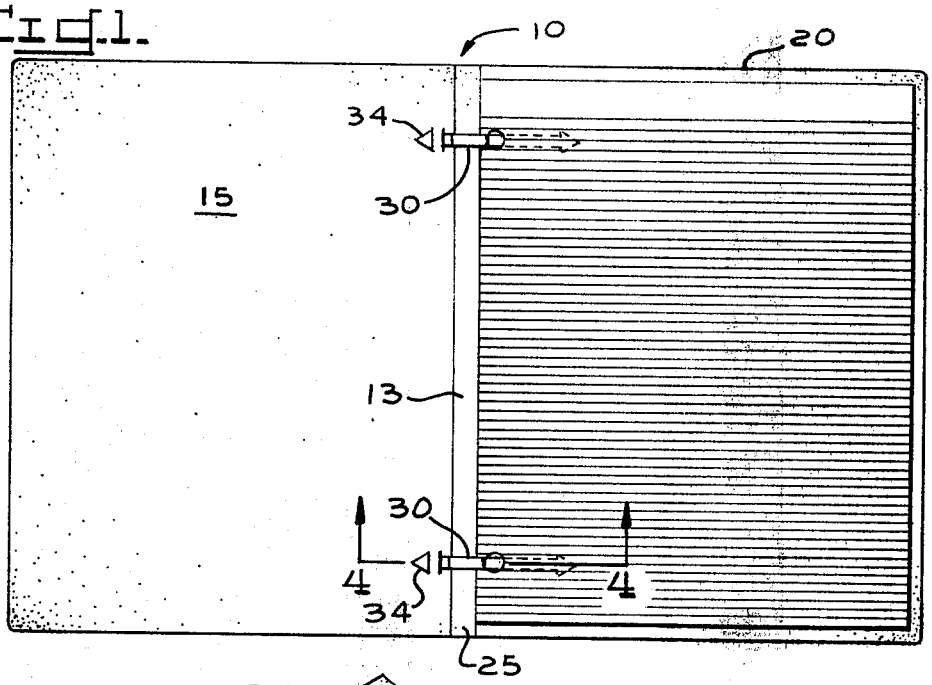
Fig. 2.
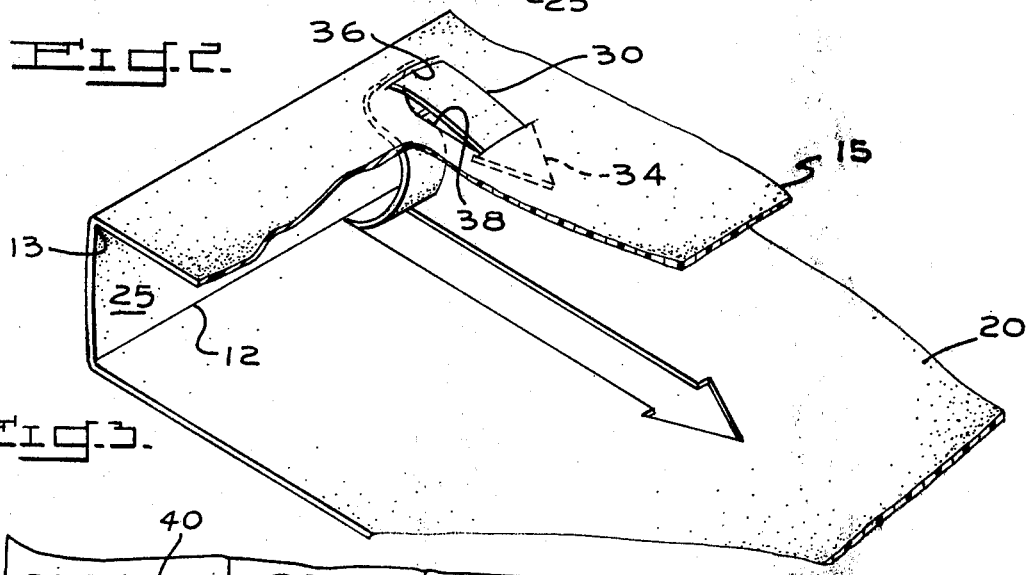
Fig. 3.
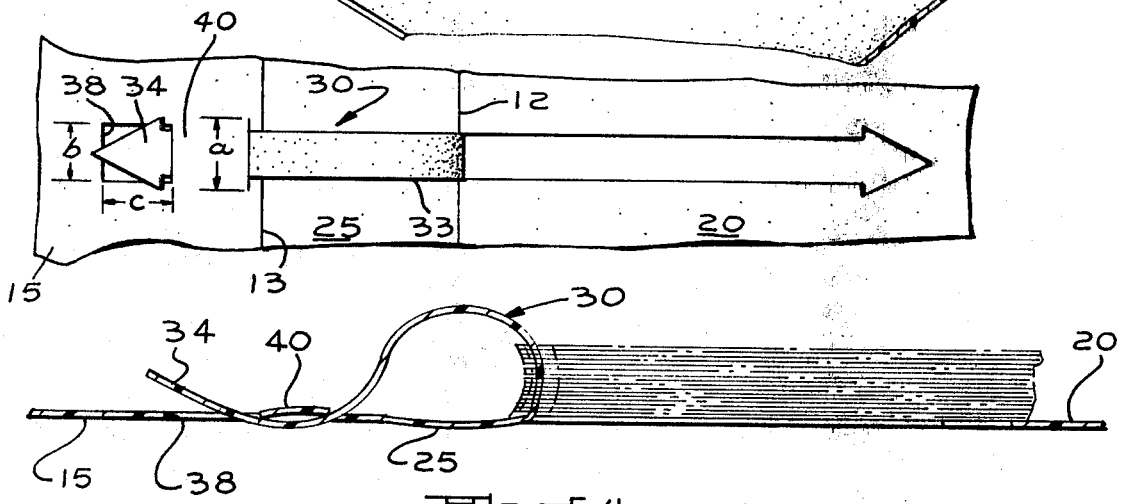
Fig. 4.

FILE FOLDER WITH INTEGRAL LOOSE LEAF BINDER RINGS

This is a continuation-in-part of U.S. patent application Ser. No. 969,801, filed Dec. 15, 1978 now abandoned.

BACKGROUND

Loose leaf binders having conventional metallic toggle ring mechanisms as a means for fastening the sheets within the binder are, of course, well known in the art. For certain uses such binders are more bulky and costly than necessary and file folders are frequently substituted therefor when relatively small number of sheets are to be bound. Accordingly, lightweight binders such as those shown in U.S. Pat. No. 2,133,069 to Williamson, No. 2,575,583 to Clarke et al, No. 2,289,949 to Wisdom and No. 2,445,671 to Johnson have been disclosed for such purposes. While these binders are characterized by economy of manufacture in that the covers are lightweight and the means by which sheets are fastened within the binder are integral with the covers, each has certain drawbacks. By way of example, the Wisdom binder requires twisting and bending of the disclosed fastening tongues. This cumbersome and tedious operation is required each time sheets are added or removed from the folder and with extended usage the tongues tend to become frayed and torn. In addition, these tongues tend to tear those portions of the loose leaf sheets adjacent the perforations thereof. In the Johnson patent only one end of a fastening strip is affixed to the binder cover, the free end having an enlarged head with foldable wings for threading through the holes of loose leaf sheets. The fastener strips being free at their outer ends do not provide binder loops or rings and the sheets are held loosely on each strip by the wing portions of the enlarged head. The Clarke binder employs a tongue which must be folded generally longitudinally each time a sheet is to be added to or removed from the binder, such folding necessarily fatigues the material forming the tongue and reduces the useful life of the binder. The Williamson binder requires the precise interfitting of the fastener tongue through a pair of narrow slits in the binder cover each time sheets are added or removed from the binder, such a practice being exacting and tedious.

Accordingly, it is a principal object of the present invention to provide a lightweight loose leaf ring binder type folder of unitary construction which overcomes the drawbacks of the prior art.

It is another object to provide such a folder which is economical to manufacture and effective in operation.

It is another object of the present invention to provide such folders which may be stacked in flat condition for compact storage, shipment and handling.

It is another object of the present invention to provide such a folder with sheet fastening means which is quickly and conveniently opened and closed for the addition to and removal of sheet material.

DESCRIPTION OF THE DRAWINGS

These and other objects will become more readily apparent from the following detailed description taken in connection with the accompanying drawings in which:

FIG. 1 is a plan view of the file folder of the present invention;

FIG. 2 is a fragmentary isometric view of the folder with portions of the folder cover broken away to show details of construction;

FIG. 3 is a fragmentary plan view of sheet fastening means employed in the folder;

FIG. 4 is a sectional view taken in the direction of line 4—4 of FIG. 1;

DESCRIPTION OF THE PREFERRED EMBODIMENT

Figure 5:
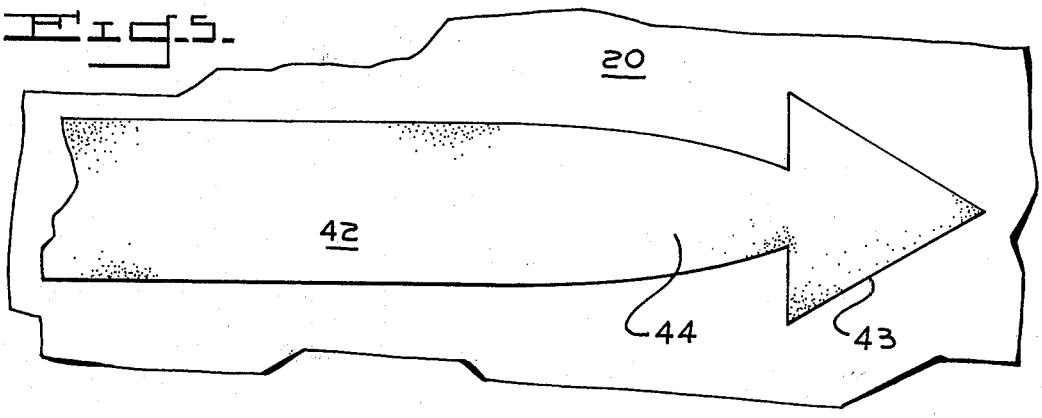
FIG. 5 is an enlarged plan view of an alternate embodiment of a fastening tongue or strip employed in the folder of the present invention.

Referring in detail to the drawings, a folder or binder of the present invention is shown generally at 10 and comprises a generally rectangular unitary sheet of resiliently flexible synthetic plastic material, such as polyethylene or the like, having a thickness in the range of about 0.015–0.050 inch. The sheet is creased or scored as shown at 12 and 13 to define front and rear cover panels 15 and 20 hingedly extending from opposite sides of a back panel 25.

The sheet material during the forming operation is punched or stamped out to provide elongated strips 30 extending outwardly from the crease or score line 12. At its outer end, each strip is provided with a barbed or enlarged arrow head as shown at 34. The strips are adapted to readily fit through the holes of standard loose leaf paper. Inasmuch as the sheet material from which the folder is formed is resiliently flexible, the strips may be readily manipulated into curvilinear ring-like configurations, such as shown at FIGS. 2 and 4 of the drawings. The shank portion 33 of the strips constitutes a flat narrow band of sufficient length to provide rings or loops of suitable diameter to hold punched loose leaf sheets in a manner similar to a ring binder.

The front cover 15 opposite the strips 30 is also punched to provide means for releasably retaining the free ends of the strips 30 in ring-like configuration, best seen in FIG. 4. The punching operation of both covers is preferably carried out simultaneously. As shown, the strip retaining means comprises a narrow slit 36 and larger rectangular cutout 38 with a transversely extending band 40 disposed therebetween. The band 40 is offset slightly above the plane of the panel 15 as best shown in FIG. 4. Displacement of band 40 is preferably accomplished during the stamping or punching operation and as a result the slit 36 opening faces toward the back panel inside the folder, thereby facilitating insertion of the enlarged tip 34 through the slit, under the raised band 40 and then through the cutout or aperture 38.

As illustrated in FIG. 3, the length a of slit 36 parallel to the score line 13 is slightly greater than the width of the arrow head shaped tip 34 measured at its base or widest dimension whereby the head may be readily fitted through the slit 36 for easy insertion and removal therethrough. The aperture 38 is generally rectangular in shape with dimension b parallel to the slit 36 being slightly less than the width of the arrow head 34 so that once the arrow head is fitted through the aperture 38 it will be locked in place. The other dimension c of the aperture 38 is made slightly less than the axial length of the arrow head 34 measured from tip to base. With these dimensional relationships and the displacement of band 40 out of the plane of panel 15, the tip 34 may be quickly and easily fitted through the slit 36, and placed in alignment with the aperture 38 against the outer surface of cover 15. By slight upward pressure exerted under the band 40 by the finger tip, the head 34 will be snapped through the marginal edges of the aperture 38 and come to rest on the inside surface of the cover panel 15 as shown in FIG. 3. The resilience of the plastic sheet material greatly facilitates this snap fitting action wherein the head 34 is tilted and/or deformed slightly so as to fit through the aperture 38. When so positioned, the head 34 is securely locked in place within the aperture 38 and the shank portion of each strip 30 will form a generally ring-like binder, as illustrated in FIG. 4. It will be realized that the tip 34 will have been threaded from inside the folder, through slit 36 to outside the folder and then inside again through the rectangular aperture 38. Since the shoulder portions at the base of head 34 engage the inner edge of the aperture 38 the strips 30 will be held in loop form against any normal forces which will be exerted on the loop portions of the strips 30 within the folder. To release the strips or tongues 30, it is necessary to open the binder and shap the head portion of the strips through the apertures 38 whereby they may be retracted through slits 36 by a simple pulling motion. Loose leaf sheets may then be removed or added to the strips 30 as desired and the arrow heads 34 reinserted in the retaining cutouts as heretofore described.

Referring to FIG. 5, there is shown a modified strip 42 having an enlarged and barbed head 43 with a reduced throat portion 44 tapered for easier insertion and removal with a mating aperture 38 (FIG. 3).

Figure 6:
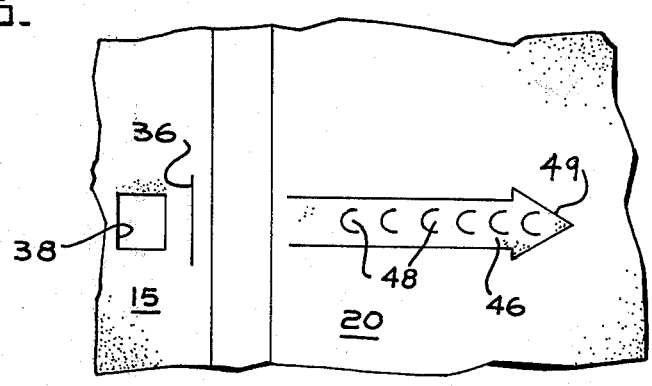
FIG. 6 is a fragmentary plan view of a second alternate embodiment of the sheet fastening means employed in the folder.
Figure 7:
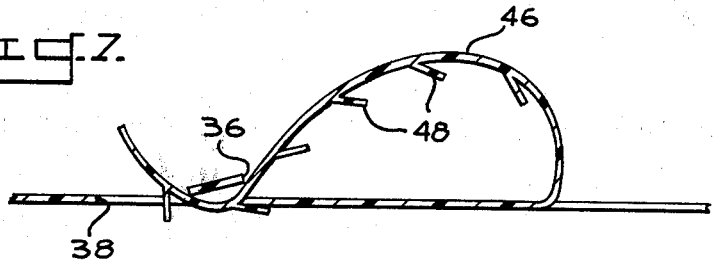
FIG. 7 is a side view partially in section of the sheet fastening means of FIG. 6 shown in an operative condition.

Referring to FIGS. 6 and 7 a second alternate bonder strip embodiment is shown at 46, this strip being of the same overall configuration as strip 30. However, unlike strip 30, which is imperforate, strip 46 is provided with a row of longitudinally spaced locking barbs or tongues 48. The tongues, integral with the strip, are preferably struck simultaneously with the stamping operation which forms the strips 46 and cuts slits and apertures 36 and 38. As best seen in FIG. 7, when the strips are disposed in a curvilinear ring-like configuration, the tongues 48 are deflected from the strip so as to extend inwardly of the strip with their free ends facing rearwardly of head 49. The tongues 48 form a type of catch mechanism and they are deflected into the plane of the strip 46 as it is inserted through slit 36 in one direction but prevent retraction of the strip in a direction of disengagement from the slit and aperture. The tongues or barbs grip the edges of the slit and prevent inadvertent removal from the aperture and slit. Release of the binder strips is accomplished by depressing the tongues into coplanar orientation with the strip prior to withdrawing the strip from the slit. It will be appreciated then that this binder strip configuration is well suited for folders from which pages are seldom changed as where the folder is used as the cover of a completed report or manuscript.

Figure 8:
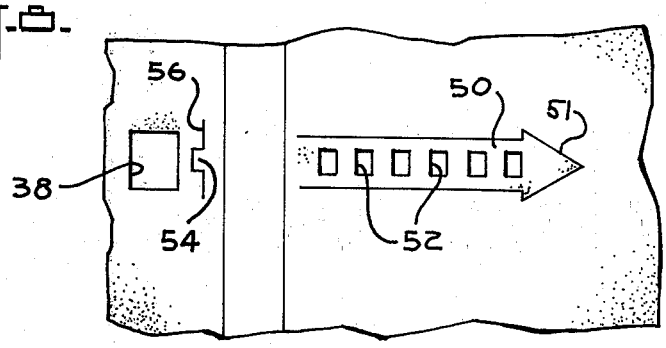
FIG. 8 is a fragmentary plan view of a third alternate embodiment of the sheet fastening means of the folder.

Referring to FIG. 8, another embodiment of the binding strip is shown at 50. The strip includes enlarged head 51 provided with retaining means by which the strip may be locked to the edge of the slit. Strip 50 is provided along the center line thereof with a row of spaced apertures 52 for receiving a lug or projection 54 formed by the slit 56. As illustrated, this lug is defined by a generally "U" shaped slit. When it is desired to secure the strip 50 to panel 15, the strip is threaded through the slit 56 in the manner described hereinabove, the lug 54 snapping in and out of each successive slot 52 in the strip in a manner similar to a pawl and ratchet. Should the strip be moved in the direction of retraction from the aperture and slit, the lug 54 will catch into one of the apertures 52 thereby preventing inadvertent removal of the strip from the slit 56. For removal of the strip, it is only necessary to deflect the lug 54 outwardly of the folder, thereby enabling the strip to be withdrawn from the slit without hindrance.

Having thus described the invention, what is claimed is:

1. A loose leaf folder comprising:

(a) a unitary sheet of flexible plastic sheet material formed to include a pair of hinged cover panels;

(b) said panels being struck at spaced locations adjacent the hinges thereof to provide a plurality of ring binder forming strips, each strip being attached to one of the panels at an inner end adjacent the hinges, said strip including a free end with an enlarged tip portion of arrowhead configuration;

(c) the other of said panels having narrow slits parallel to the hinges and an aperture spaced outwardly of each slit, one such slit and panel aperture being disposed in registered alignment with each ring binder strip for receiving the enlarged tip thereof when the strips are reversibly bowed from one panel toward the other panel;

(d) each of said slits having a length greater than the largest width of its associated arrowhead tip portion, whereby the tip portion may be readily fitted through the slit for easy insertion and removal therethrough; and (e) each of said apertures being substantially rectangular with two marginal edges being parallel to the slit, said aperture having a width less than said largest width of the arrowhead portion and a length less than the axial length of said arrowhead portion measured from arrowhead tip to arrowhead base, whereby the arrowhead tip portion may be quickly and easily fitted through the aperture and removably locked in place.

2. A loose leaf folder according to claim 1 wherein each strip has longitudinally extending marginal edges and is provided with at least one aperture spaced from said marginal edges, and each slit includes a lug portion defining a projection receivable within said aperture to prevent inadvertent disengagement of said strip from said other panel.

* * * * *